US005175073A

United States Patent [19]

Gingello et al.

[11] Patent Number: 5,175,073

[45] Date of Patent: * Dec. 29, 1992

[54] NUCLEATED CONTACT FILM FOR USE IN GRAPHIC ARTS

[75] Inventors: Anthony D. Gingello, Rochester; David F. Jennings, Penfield; Richard D. Lucitte, Holcomb; Hermano P. Rocha, Rochester, all of N.Y.

[73] Assignee: Eastman Kodak Company, Rochester, N.Y.

[ * ] Notice: The portion of the term of this patent subsequent to Oct. 29, 2008 has been disclaimed.

[21] Appl. No.: 675,235

[22] Filed: Mar. 26, 1991

[51] Int. Cl.[5] ..... G03C 1/36; G03C 1/32; G03C 1/08; G03C 1/04

[52] U.S. Cl. ..... 430/264; 430/523; 430/531; 430/539; 430/950; 430/961

[58] Field of Search ..... 430/264, 539, 950, 961, 430/531, 523

[56] References Cited

U.S. PATENT DOCUMENTS

| | | | |
|---|---|---|---|
| 4,232,117 | 3/1980 | Naoi et al. | 430/539 |
| 4,343,873 | 7/1982 | Sasaoka | 430/1 |
| 4,777,113 | 11/1988 | Inoue et al. | 430/264 |
| 4,818,659 | 2/1989 | Takahashi et al. | 430/264 |
| 4,847,180 | 1/1989 | Miyata et al. | 430/264 |
| 4,855,219 | 10/1989 | Bagchi et al. | 430/496 |
| 4,914,012 | 6/1990 | Kawai | 430/536 |
| 4,933,272 | 5/1990 | McDugle et al. | 430/567 |
| 4,975,354 | 6/1990 | Machonkin et al. | 430/264 |
| 5,061,595 | 10/1991 | Gingello et al. | 430/264 |
| 5,085,970 | 2/1992 | Kameoka et al. | 430/264 |

*Primary Examiner*—Richard L. Schilling
*Attorney, Agent, or Firm*—Alfred P. Lorenzo

[57] ABSTRACT

A high-contrast room-light-handleable black-and-white silver halide photographic film especially adapted for use as a dry-dot-etchable contact film in the graphic arts is comprised of a support having in order on one side thereof (1) a radiation-sensitive layer comprising silver halide grains, a hydrophilic colloid and a polymer latex, (2) an interlayer comprising a hydrophilic colloid and a polymer latex, and (3) an overcoat layer comprising a hydrophilic colloid, a matting agent and a light-scattering agent, wherein the interlayer has a refractive index in the range of from about 1.4 to about 1.7 and a thickness which is in the range of from about 0.5 to about 5 microns and is at least twice that of the overcoat layer, and wherein the film contains in the radiation-sensitive layer, or a layer contiguous thereto, a hydrazine compound which functions as a nucleating agent. The combination of the light-scattering agent in the overcoat layer and the thick interlayer facilitates optical spreading of the image during contact exposure, and thereby enhances the performance of the contact film in use with multi-layer originals and in processes of dry dot etching. Futher improvement in performance is provided by the hydrazine compound which provides chemical image spread to supplement the optical image spread.

17 Claims, No Drawings

NUCLEATED CONTACT FILM FOR USE IN GRAPHIC ARTS

CROSS-REFERENCE TO RELATED APPLICATIONS

U.S. patent application Ser. No. 590,707, filed Sep. 24, 1990, by A. D. Gingello et al and issued Oct. 29, 1991, as U.S. Pat. No. 5,061,595 describes a non-nucleated high-contrast room-light-handleable black-and-white silver halide photographic film which is especially adapted for use as a dry-dot-etchable contact film in the graphic arts by its ability to optically spread an image during contact exposure.

FIELD OF THE INVENTION

This invention relates in general to photography and in particular to black-and-white silver halide photographic films. More specifically, this invention relates to high-contrast nucleated black-and-white silver halide photographic films which are adapted for room-light handling and especially useful in the field of graphic arts.

BACKGROUND OF THE INVENTION

An important class of photographic films are black-and-white silver halide films intended to be used for contact exposures in the field of graphic arts. Such films require a high degree of dimensional stability as well as a surface which is non-tacky, and has a suitable degree of roughness to facilitate rapid vacuum draw-down during contact exposure. Advantageously, these films are relatively low in photographic speed so that they can be used under bright safelight or even ordinary room-light conditions. To facilitate handling in use, it is highly desirable that the front and back surfaces of the contact film be readily distinguishable by the user.

An additional highly desirable property for the aforesaid graphic arts contact films is the ability to optically spread the image during contact exposure. Thus, for example, in employing dot image originals, it is desirable to be able to regulate the degree of dot growth that occurs on contact exposure. Also, the original which is to be exposed in the contact exposure process can, in some instances, be a multi-layer original, that is, an original in which two or more elements have been stacked together as an assembly. Such a multi-layer assembly can include both line image originals and dot image originals. The ability to optically spread the image during exposure is critically important in handling such stacked originals in a single exposure process. In particular, optical spreading can improve the image quality of characters produced from originals which are out of contact under the conditions described in the aforesaid U.S. patent application Ser. No. 590,707, filed Sep. 24, 1990.

Optical image spread is distinguished from chemical image spread which involves infectious imagewise development of unexposed photographic silver halide grains in close proximity to exposed photographic silver halide grains. Chemical image spread is achieved by incorporation of a nucleating agent in either the film or the developing solution. A given system can employ either optical image spread or chemical image spread or both.

To facilitate optical spreading of an image during contact exposure, it is important that the silver halide emulsion layer of the contact film be widely spaced from the surface of the contact film that comes into face-to-face contact with the original, such surface typically being the surface of a protective overcoat layer which serves as the outermost layer of the film.

It is increasingly common in the graphic arts to employ a computer assisted "dry dot etching" process in making color corrections to halftone separations. The process can be carried out without the use of masks for color correction of an entire separation, or it can be done with hand-cut masks or photographic masks for local color corrections. Techniques used in dry dot etching vary from shop to shop, but all depend on the ability of a contact or duplicating film to change dot size with overexposure (overexposure meaning an exposure greater than that necessary to produce dot-for-dot reproduction in the midtone dot values). Generally, the dot-change exposure technique starts with a dot-for-dot exposure and adds a "bump", or additional, exposure to produce the desired change in dot value. This "bump" exposure may be confined to a localized area of the subject by masking, or it may be combined with the dot-for-dot exposure to make an overall change to the separation. Contact films which are best suited for use in dry dot etching are those that provide a high degree of optical spread.

It is exceedingly difficult to incorporate in a photographic film all of the properties that are desirable for use as a contact exposure film in the graphic arts. Thus, for example, the use of a very thick overcoat layer to provide the desired spacing between the surface of the film and the silver halide emulsion layer is impractical, since it adversely affects dimensional stability. To improve dimensional stability, a polymer latex can be incorporated in the overcoat layer, but this tends to render the surface undesirably tacky. Also, if the overall thickness of the hydrophilic layers, including the emulsion layer and overcoat layer, becomes too great, the diffusion of developing agents and fixing agents to the emulsion layer will be impeded and the time required for development and fixing will be excessive. Yet another problem will be the prolonged drying period needed to dry the processed film.

The present invention is directed to a novel contact film for use in the graphic arts which effectively overcomes all of the above problems and combines a wide variety of desired features in a single film.

SUMMARY OF THE INVENTION

In accordance with this invention, a high-contrast room-light-handleable black-and-white silver halide photographic film especially adapted for use as a dry-dot-etchable contact film in the graphic arts is comprised of a support having in order on one side thereof (1) a radiation-sensitive layer comprising silver halide grains, a hydrophilic colloid and a polymer latex, (2) an interlayer comprising a hydrophilic colloid and a polymer latex, and (3) an overcoat layer comprising a hydrophilic colloid, a matting agent and a light-scattering agent, wherein the interlayer has a refractive index in the range of from about 1.4 to about 1.7 and a thickness which is in the range of from about 0.5 to about 5 microns and is at least twice that of the overcoat layer.

In addition to the above features, this invention includes the incorporation in the radiation-sensitive layer, or a layer contiguous thereto, of a hydrazine compound which functions as a nucleating agent. As explained hereinabove, the use of a nucleating agent brings about infectious imagewise development of unexposed photographic silver halide grains in close proximity to exposed photographic silver halide grains. This is referred to as "chemical image spread". Thus, in the present invention, the optical image spread is supplemented by chemical image spread to thereby achieve improved photographic performance.

The novel photographic film of this invention has good dimensional stability characteristics and a non-tacky matte surface which facilitates rapid vacuum draw-down during contact exposure. It is room-light-handleable and capable of producing images of the high contrast desired in the graphic arts. The overcoat layer is characterized by a degree of haze sufficient to enable the user to readily distinguish between the front and back surfaces of the film. The overall thickness of the combination of emulsion layer, interlayer and overcoat layer is such that development and fixing can be carried out in suitably short periods of time. The combination of the light-scattering agent in the overcoat layer and the thick interlayer facilitates optical spreading of the image during contact exposure, and thereby enhances the performance of the contact film in use with multilayer originals and in processes of dry dot etching. This enhanced performance is further improved by the presence in the emulsion layer, or a layer contiguous thereto, of a hydrazine compound which functions as a nucleating agent, and thereby provides chemical image spread.

DESCRIPTION OF THE PREFERRED EMBODIMENTS

U.S. Pat. application Ser. No. 590,707 filed Sep. 24, 1990, now U.S. Pat. No. 5,061,595, "Contact Film For Use In Graphic Arts", by A. D. Gingello et al describes a high-contrast room-light-handleable black-and-white silver halide photographic film comprising a support having in order on one side thereof:

(1) a radiation-sensitive layer comprising silver halide grains, a hydrophilic colloid and a polymer latex, (2) an interlayer comprising a hydrophilic colloid and a polymer latex, and (3) an overcoat layer comprising a hydrophilic colloid, a matting agent and a light-scattering agent, the interlayer having a refractive index in the range of from about 1.4 to about 1.7 and a thickness which is at least twice that of the overcoat layer and is in the range of from about 0.5 to about 5 microns. The present invention is an improvement in the invention of U.S. Pat. application Ser. No. 590,707, wherein an effective amount of a hydrazine compound which functions as a nucleating agent is incorporated in the radiation-sensitive layer or a layer contiguous thereto.

The contact film of this invention can utilize any of the polymeric film supports known for use in the photographic arts. Typical of useful polymeric film supports are films of cellulose nitrate and cellulose esters such as cellulose triacetate and diacetate, polystyrene, polyamides, homo- and co-polymers of vinyl chloride, poly(vinylacetal), polycarbonate, homo and co-polymers of olefins, such as polyethylene and polypropylene and polyesters of dibasic aromatic carboxylic acids with divalent alcohols, such as poly(ethylene terephthalate).

Polyester films, such as films of polyethylene terephthalate, have many advantageous properties, such as excellent strength and dimensional stability, which render them especially advantageous for use as supports in the present invention.

The polyester film supports which can be advantageously employed in this invention are well known and widely used materials. Such film supports are typically prepared from high molecular weight polyesters derived by condensing a dihydric alcohol with a dibasic saturated fatty carboxylic acid or derivatives thereof. Suitable dihydric alcohols for use in preparing polyesters are well known in the art and include any glycol, wherein the hydroxyl groups are on the terminal carbon atom and contain from 2 to 12 carbon atoms such as, for example, ethylene glycol, propylene glycol, trimethylene glycol, hexamethylene glycol, decamethylene glycol, dodecamethylene glycol, and 1,4-cyclohexane dimethanol. Dibasic acids that can be employed in preparing polyesters are well known in the art and include those dibasic acids containing from 2 to 16 carbon atoms. Specific examples of suitable dibasic acids include adipic acid, sebacic acid, isophthalic acid, and terephthalic acid. The alkyl esters of the above-enumerated acids can also be employed satisfactorily. Other suitable dihydric alcohols and dibasic acids that can be employed in preparing polyesters from which sheeting can be prepared are described in J. W. Wellman, U.S. Pat. No. 2,720,503, issued Oct. 11, 1955.

Specific preferred examples of polyester resins which, in the form of sheeting, can be used in this invention are poly(ethylene terephthalate), poly(cyclohexane 1,4-dimethylene terephthalate), and the polyester derived by reacting 0.83 mol of dimethyl terephthalate, 0.17 mol of dimethyl isophthalate and at least one mol of 1,4-cyclohexanedimethanol. U.S. Pat. No. 2,901,466 discloses polyesters prepared from 1,4-cyclohexanedimethanol and their method of preparation.

The thickness of the polyester sheet material employed in carrying out this invention is not critical. For example, polyester sheeting of a thickness of from about 0.05 to about 0.25 millimeters can be employed with satisfactory results.

In a typical process for the manufacture of a polyester photographic film support, the polyester is melt extruded through a slit die, quenched to the amorphous state, oriented by transverse and longitudinal stretching, and heat set under dimensional restraint. In addition to being directionally oriented and heat set, the polyester film can also be subjected to a subsequent heat relax treatment to provide still further improvement in dimensional stability and surface smoothness.

In the contact film described herein, the layer overlying the support is a negative-working emulsion layer comprising a hydrophilic colloid, a polymer latex and radiation-sensitive silver halide grains capable of forming a surface latent image. One or more subbing layers which function to enhance the bonding of the silver halide emulsion layer to the support are also advantageously included in the film.

The photographic films of this invention are high contrast films with the particular contrast value, as indicated by gamma ($\gamma$), depending on the type of emulsion employed. Gamma is a measure of contrast that is well-known in the art as described, for example, in James, The Theory of the Photographic Process, 4th Ed., 502, MacMillan Publishing Co., 1977.

The useful silver halide emulsions include silver chloride, silver bromide, silver chlorobromide, silver bromoiodide, silver chloroiodide and silver chlorobromoiodide emulsions.

The silver halide grains useful in the practice of the invention may be of any known configuration, including regular octahedral, cubic, or tabular grains, as described, for example, in *Research Disclosure*, Item 17643, December 1978, Section I, and *Research Disclosure*, Item 22534, January, 1983. The silver halide grains preferably have a mean grain size of not greater than about 0.7μ and more preferably of about 0.4μ or less. As is recognized in the art, higher contrasts can be achieved by using relatively monodispersed emulsions, particularly when larger grain size emulsions are employed. As used herein, the term "monodispersed" means that the emulsion has a coefficient of variation of less than about 20%. For the highest levels of contrast, the coefficient of variation is preferably less than about 10%. As used herein, the term "coefficient of variation" is defined as 100 times the standard deviation of the grain diameter divided by the mean grain diameter.

The amount of silver in the contact film of this invention is preferably in the range of from about 0.01 to about 0.05 moles per square meter.

In the contact film of this invention, room-light-handleable characteristics can be achieved by any of several procedures. For example, absorbing layers can be used to screen undesired radiation from coming into contact with the silver halide emulsion layer. Filter dyes can be used to achieve this objective. Alternatively, an absorbing layer comprising silver halide grains of reduced photosensitivity can be employed. Such layers are described in copending commonly assigned U.S. patent application Ser. No. 475,542, entitled "Absorbing Layer For Photographic Speed Reduction", filed by A. D. Gingello et al on Feb. 6, 1990, the disclosure of which is incorporated herein by reference. As a further alternative, a doping agent can be incorporated in the silver halide grains of the radiation-sensitive silver halide emulsion layer in an amount effective to reduce the speed sufficiently to provide the desired roomlight-handleable characteristics. Use of such doping agents is a preferred technique in the present invention.

McDugle et al, U.S. Pat. No. 4,933,272 issued Jun. 12, 1990, the disclosure of which is incorporated herein by reference, discloses silver halide emulsions comprised of radiation sensitive silver halide grains exhibiting a face centered cubic crystal lattice structure internally containing a nitrosyl or thionitrosyl coordination ligand and a transition metal chosen from groups 5 to 10 inclusive of the periodic table of elements. These emulsions are preferred for use in the contact film of this invention.

In accordance with the aforesaid U.S. Pat. No. 4,933,272, the dopants contained within the silver halide grains are transition metal coordination complexes which contain one or more nitrosyl or thionitrosyl ligands. These ligands have the formula:

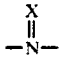

where X is oxygen in the case of nitrosyl ligands and sulfur in the case of thionitrosyl ligands.

Preferred dopants utilized in this invention are transition metal coordination complexes having the formula:

$$[M(NX)(L)_5]_n$$

wherein:

M is a ruthenium, rhenium, chromium, osmium or iridium transition metal;

X is oxygen or sulfur;

L is a ligand; and n is −1, −2, or −3.

As in the aforesaid U.S. Pat. No. 4,933,272, all references herein to periods and groups within the periodic table of elements are based on the format of the periodic table adopted by the American Chemical Society and published in the *Chemical and Engineering News*, Feb. 4, 1985, p. 26. In this form the prior numbering of the periods was retained, but the Roman numeral numbering of groups and designations of A and B groups (having opposite meanings in the U.S. and Europe) was replaced by a simple left to right 1 through 18 numbering of the groups.

Silver halide emulsions also contain a hydrophilic colloid that serves as a binder or vehicle. The proportion of hydrophilic colloid can be widely varied, but typically is within the range of from about 20 to 250 g/mole silver halide. The presence of excessive levels of hydrophilic colloid can reduce maximum image density and, consequently, contrast. Thus, for γ values of 10 or more, the vehicle is preferably present at a level of less than 200 g/mole silver halide.

The hydrophilic colloid is preferably gelatin, but many other suitable hydrophilic colloids are also known to the photographic art and can be used alone or in combination with gelatin. Suitable hydrophilic colloids include naturally occurring substances such as proteins, protein derivatives, cellulose derivatives—e.g., cellulose esters, gelatin—e.g., alkali-treated gelatin (cattle bone or hide gelatin) or acid-treated gelatin (pigskin gelatin), gelatin derivatives—e.g., acetylated gelatin, phthalated gelatin and the like, polysaccharides such as dextran, gum arabic, zein, casein, pectin, collagen derivatives, collodion, agar-agar, arrowroot, albumin, and the like.

In addition to the hydrophilic colloid and the silver halide grains, the radiation-sensitive silver halide emulsion layer employed in the contact film of this invention includes a polymer latex which serves to improve the dimensional stability of the film. Polymers useable in latex form for this purpose are very well known in the photographic art. The requirements for such a polymer latex are (1) that it not interact with the hydrophilic colloid such that normal coating of the emulsion layer is not possible, (2) that it have optical properties, i.e., refractive index, similar to that of the hydrophilic colloid, and (3) that it have a glass transition temperature such that it is plastic at room temperature. Preferably, the glass transition temperature is below 20° C.

The polymer latex useful in the present invention is an aqueous dispersion of a water-insoluble polymer. It is incorporated in the emulsion layer in an amount that is typically in the range of from about 0.2 to about 1.5 parts per part by weight of the hydrophilic colloid.

The synthetic polymeric latex materials referred to herein are generally polymeric materials which are relatively insoluble in water compared to water-soluble polymers, but have sufficient water solubility to form colloidal suspensions of small polymeric micelles. Typical latex polymeric materials can be made by rapid copolymerization with vigorous agitation in a liquid carrier of at least one monomer which would form a hydrophobic homopolymer and at least one monomer which would form a hydrophilic homopolymer. In certain preferred embodiments, from about 1 to about 30 percent, by weight, of units of monomer containing the water-solubilizing group is present in the copolymer product. Copolymers prepared by this method and analogous methods provide discrete micelles of the copolymer which have low viscosities in aqueous suspensions. Typical useful copolymers include interpolymers of acrylic esters and sulfoesters as disclosed in Dykstra, U.S. Pat. No. 3,411,911 issued Nov. 19, 1968, interpolymers of acrylic esters and sulfobetains as described in Dykstra and Whiteley, U.S. Pat. No. 3,411,912 issued Nov. 19, 1968, interpolymers of alkyl acrylates and acrylic acids as disclosed in Ream and Fowler, U.S. Pat. No. 3,287,289 issued Nov. 22, 1966, interpolymers of vinyl acetate, alkyl acrylates and acrylic acids as disclosed in Corey, U.S. Pat. No. 3,296,169, and interpolymers as disclosed in Smith, U.S. Pat. No. 3,459,790 issued Aug. 5, 1969. Polymeric latex materials can also be made by rapid polymerization with vigorous agitation of hydrophobic polymers when polymerized in the presence of high concentrations of surfactants which contain water-solubilizing groups. The surfactants are apparently entrained in the micelle and the solubilizing group of the surfactant provides sufficient compatibility with aqueous liquids to provide a dispersion very much like a soap. Generally good latex materials are also disclosed in Nottorf, U.S. Pat. No. 3,142,568 issued Jul. 28, 1964; White, U.S. Pat. No. 3,193,386 issued Jul. 6, 1965; Houck et al, U.S. Pat. No. 3,062,674 issued Nov. 6, 1962; and Houck et al, U.S. Pat. No. 3,220,844 issued Nov. 30, 1965.

The synthetic polymeric latex materials are generally polymerized in a manner to produce micelles of about 1.0 micron average diameter or smaller to be highly useful in photographic emulsions and preferably the discrete micelles are less than 0.3 micron in average diameter. Generally, the micelles can be observed by photomicrographs when incorporated in gelatino emulsions, however, it is understood that some coalescing can occur when the emulsions are coated and dried.

In one embodiment, the latex polymers which can be used according to this invention are acrylic interpolymers, i.e., those interpolymers prepared from polymerizable acrylic monomers containing the characteristic acrylic group

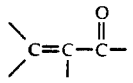

Such polymers are conveniently prepared by the interpolymerization of an acrylic monomer with at least one dissimilar monomer which can be another acrylic monomer or some other different polymerizable ethylenically unsaturated monomer. It is, of course, understood that the acrylic interpolymers employed in the practice of this invention are compatible with gelatin and have a Tg (glass transition temperature) of less than 20° C. (Tg can be calculated by differential thermal analysis as disclosed in "Techniques and Methods of Polymer Evaluation", Vol. 1, Marcel Dekker, Inc., N.Y., 1966).

A particularly preferred polymer latex for use in the silver halide emulsion layer is poly(methylacrylate-co-2-acrylamido-2-methyl propane sulfonic acid) which is comprised of repeating units of the formula:

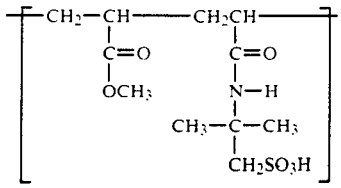

The thickness of the radiation-sensitive silver halide emulsion layer in the improved contact film of this invention is typically in the range of from about 1 to about 9 microns, and more preferably in the range of from about 2 to about 4 microns.

The term "room-light-handleable", as used herein, is intended to denote that the film can be exposed to a light level of 200 lux for several minutes without a significant loss in maximum density. Typically, such materials require on the order of 10,000 ergs per square centimeter for $D_{min}$ exposure.

In addition to silver halide grains, a hydrophilic colloid and a polymer latex, the radiation-sensitive layer employed in the photographic film of this invention preferably contains an effective amount of a hydrazine compound which functions as a nucleating agent. As an alternative to incorporation in the radiation-sensitive layer, the hydrazine compound can be incorporated in a layer contiguous thereto. Any hydrazine compound that functions as a nucleator and is capable of being incorporated in a silver halide emulsion layer, or a layer contiguous thereto, can be used in the practice of this invention. Hydrazine compounds can, of course, be included both in the silver halide emulsion layer and in one or more other layers of the photographic film.

Preferred photographic elements within the scope of this invention include elements containing a hydrazine compound of the formula:

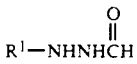

wherein $R^1$ is a phenyl nucleus having a Hammett sigma value-derived electron withdrawing characteristic of less than +0.30.

In the above formula, $R^1$ can take the form of a phenyl nucleus which is either electron donating (electropositive) or electron withdrawing (electronegative); however, phenyl nuclei which are highly electron withdrawing produce inferior nucleating agents. The electron withdrawing or electron donating characteristic of a specific phenyl nucleus can be assessed by reference to Hammett sigma values. The phenyl nucleus can be assigned a Hammett sigma value-derived electron withdrawing characteristic which is the algebraic sum of the Hammett sigma values of its substituents (i.e., those of the substituents, if any, to the phenyl group). For example, the Hammett sigma values of any substituents to the phenyl ring of the phenyl nucleus can be determined algebraically simply by determining from the literature the known Hammett sigma values for each substituent and obtaining the algebraic sum thereof. Electron donating substituents are assigned negative sigma values. For example, in one preferred form, $R^1$ can be a phenyl group which is unsubstituted. The hydrogens attached to the phenyl ring each have a Hammett sigma value of 0 by definition. In another form, the phenyl nuclei can include halogen ring substituents. For example, ortho- or para-chloro or fluoro substituted phenyl groups are specifically contemplated, although the chloro and fluoro groups are each mildly electron withdrawing.

Preferred phenyl group substituents are those which are not electron withdrawing. For example, the phenyl groups can be substituted with straight or branched chain alkyl groups (e.g., methyl, ethyl, n-propyl, isopropyl, n-butyl, isobutyl, n-hexyl, n-octyl, tert-octyl, n-decyl, n-dodecyl and similar groups). The phenyl groups can be substituted with alkoxy groups wherein the alkyl moieties thereof can be chosen from among the alkyl groups described above. The phenyl groups can also be substituted with acylamino groups. Illustrative acylamino groups include acetylamino, propanoylamino, butanoylamino, octanoylamino, benzoylamino, and similar groups.

In one particularly preferred from the alkyl, alkoxy and/or acylamino groups are in turn substituted with a conventional photographic ballast, such as the ballasting moieties of incorporated couplers and other immobile photographic emulsion addenda. The ballast groups typically contain at least eight carbon atoms and can be selected from both aliphatic and aromatic relatively unreactive groups, such as alkyl, alkoxy, phenyl, alkylphenyl, phenoxy, alkylphenoxy and similar groups.

The alkyl and alkoxy groups, including ballasting groups, if any, preferably contain from 1 to 20 carbon atoms, and the acylamino groups, including ballasting groups, if any, preferably contain from 2 to 21 carbon atoms. Generally, up to about 30 or more carbon atoms in these groups are contemplated in their ballasted form. Methoxyphenyl, tolyl (e.g., p-tolyl and m-tolyl) and ballasted butyramidophenyl nuclei are specifically preferred.

Examples of the specifically preferred hydrazine compounds are the following:

1-Formyl-2-(4-[2-(2,4-di-tert-pentylphenoxy)-butyramido]phenyl)hydrazine

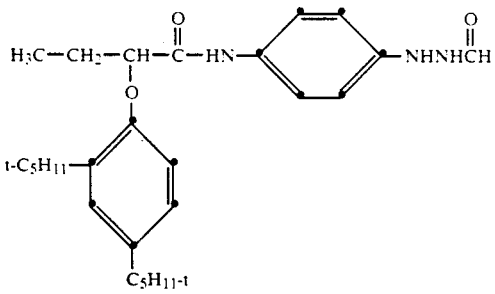

1-Formyl-2-phenylhydrazine

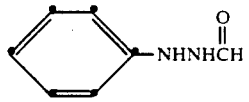

1-Formyl-2-(4-methoxyphenyl)hydrazine

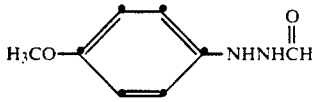

1-Formyl-2-(4-chlorophenyl)hydrazine

-continued

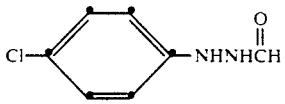

1-Formyl-2-(4-fluorophenyl)hydrazine

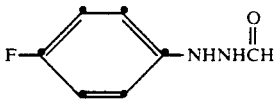

1-Formyl-2-(2-chlorophenyl)hydrazine

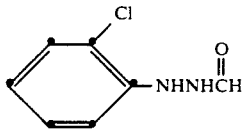

1-Formyl-2-(p-tolyl)hydrazine

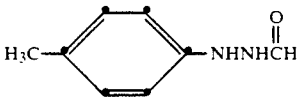

Preferred photographic elements within the scope of this invention also include those in which the hydrazide comprises an adsorption promoting moiety. Hydrazides of this type contain an unsubstituted or mono-substituted divalent hydrazo moiety and an acyl moiety. The adsorption promoting moiety can be chosen from among those known to promote adsorption of photographic addenda to silver halide grain surfaces. Typically, such moieties contain a sulfur or nitrogen atom capable of complexing with silver or otherwise exhibiting an affinity for the silver halide grain surface. Examples of preferred adsorption promoting moieties include thioureas, heterocyclic thioamides and triazoles. Exemplary hydrazides containing an adsorption promoting moiety include:

1-[4-(2-formylhydrazino)phenyl]-3-methyl thiourea

3-[4-(2-formylhydrazino)phenyl-5-(3-methyl-2-benzoxazolinylidene)rhodanine-6-([4-(2-formylhydrazino)-phenyl]ureylene)-2-methylbenzothiazole N-(benzotriazol-5-yl)-4-(2-formylhydrazino)-phenylacetamide N-(benzotriazol-5-yl)-3-(5-formylhydrazino-2-methoxyphenyl)propionamide and N-2-(5,5-dimethyl-2-thiomidazol-4-yl-idenimino)ethyl-3-[5-(formylhydrazino)-2-methoxyphenyl]propionamide.

Hydrazine compounds incorporated in the photographic element of this invention are typically employed in a concentration of from about $10^{-4}$ to about $10^{-1}$ mole per mole of silver, more preferably in an amount of from about $5\times10^{-4}$ to about $5\times10^{-2}$ mole per mole of silver, and most preferably in an amount of from about $8\times10^{-4}$ to about $5\times10^{-3}$ mole per mole of silver. The hydrazines containing an adsorption promoting moiety can be used at a level as low as about $5\times10^{-6}$ mole per mole of silver.

An especially preferred class of hydrazine compounds for use in the elements of this invention are the hydrazine compounds described in Machonkin et al, U.S. Pat. No. 4,912,016 issued Mar. 27, 1990,. These compounds are aryl hydrazides of the formula:

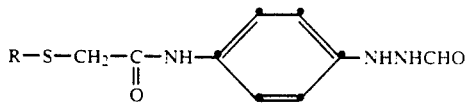

where R is an alkyl or cycloalkyl group.

Another especially preferred class of hydrazine compounds for use in the elements of this invention are the hydrazine compounds described in Looker et al, U.S. Pat. No. 5,104,769, issued Apr. 14, 1992.

The hydrazine compounds described in U.S. Pat. No. 5,104,769 have one of the following structural formulae:

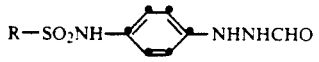

I or

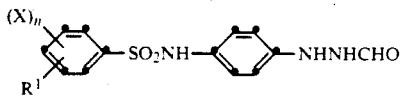

II wherein:

R is alkyl having from 6 to 18 carbon atoms or a heterocylic ring having 5 or 6 ring atoms, including ring atoms of sulfur or oxygen;

$R^1$ is alkyl or alkoxy having from 1 to 12 carbon atoms;

X is alkyl, thioalkyl or alkoxy having from 1 to about 5 carbon atoms; halogen; or $-NHCOR^2$, $-NHSO_2R^2$, $-CONR^2R^3$ or $-SO_2R^2R^3$ where $R^2$ and $R^3$, which can be the same or different, are hydrogen or alkyl having from 1 to about 4 carbon atoms; and n is 0, 1 or 2.

Alkyl groups represented by R can be straight or branched chain and can be substituted or unsubstituted. Substituents include alkoxy having from 1 to about 4 carbon atoms, halogen atoms (e.g. chlorine and fluorine), or $-NHCOR^2$ or $-NHSO_2R^2$ where $R^2$ is as defined above. Preferred R alkyl groups contain from about 8 to about 16 carbon atoms since alkyl groups of this size impart a greater degree of insolubility to the hydrazide nucleating agents and thereby reduce the tendency of these agents to be leached during development from the layers in which they are coated into developer solutions.

Heterocyclic groups represented by R include thienyl and furyl, which groups can be substituted with alkyl having from 1 to about 4 carbon atoms or with halogen atoms, such as chlorine.

Alkyl or alkoxy groups represented by $R^1$ can be straight or branched chain and can be substituted or unsubstituted. Substituents on these groups can be alkoxy having from 1 to about 4 carbon atoms, halogen atoms (e.g. chlorine or fluorine); or $-NHCOR^2-$ or $-NHSO_2R^2$ where $R^2$ is as defined above. Preferred alkyl or alkoxy groups contain from 1 to 5 carbon atoms in order to impart sufficient insolubility to the hydrazide nucleating agents to reduce their tendency to being leached out of the layers in which they are coated by developer solution.

Alkyl, thioalkyl and alkoxy groups which are represented by X contain from 1 to about 5 carbon atoms and can be straight or branched chain. When X is halogen, it may be chlorine, fluorine, bromine or iodine. Where more than one X is present, such substituents can be the same or different.

Yet another especially preferred class of hydrazine compounds are aryl sulfonamidophenyl hydrazides containing ethyleneoxy groups which have the formula:

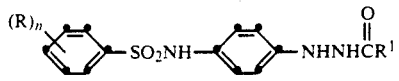

II where each R is a monovalent group comprised of at least three repeating ethyleneoxy units, n is 1 to 3, and $R^1$ is hydrogen or a blocking group.

These hydrazides are described in Machonkin et al, U.S. Pat. No. 5,041,355, issued Aug. 20, 1991.

Still another especially preferred class of hydrazine compounds are aryl sulfonamidophenyl hydrazides containing both thio and ethyleneoxy groups which have the formula:

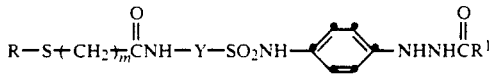

where R is a monovalent group comprised of at least three repeating ethyleneoxy units, m is 1 to 6, Y is a divalent aromatic radical, and $R^1$ is hydrogen or a blocking group. The divalent aromatic radical represented by Y, such as a phenylene radical or naphthalene radical, can be unsubstituted or substituted with one or more substituents such as alkyl, halo, alkoxy, haloalkyl or alkoxyalkyl.

These hydrazides are described in Machonkin et al, U.S. Pat. No. 4,988,604, issued Jan. 29, 1991.

Still another preferred class of hydrazine compounds for use in the elements of this invention are aryl sulfonamidophenyl hydrazides containing an alkyl pyridinium group which have the formula:

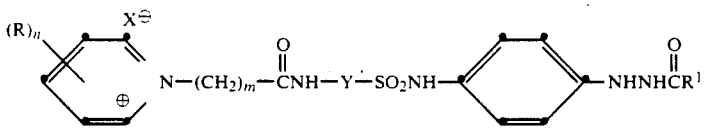

where each R is an alkyl group, preferably containing 1 to 12 carbon atoms, n is 1 to 3, X is an anion such as chloride or bromide, m is 1 to 6, Y is a divalent aromatic radical, and $R^1$ is hydrogen or a blocking group. The divalent aromatic radical represented by Y, such as a phenylene radical or naphthalene radical, can be unsubstituted or substituted with one or more substituents such as alkyl, halo, alkoxy, haloalkyl or alkoxyalkyl. Preferably, the sum of the number of carbon atoms in the alkyl groups represented by R is at least 4 and more preferably at least 8. The blocking group represented by $R^1$ can be, for example:

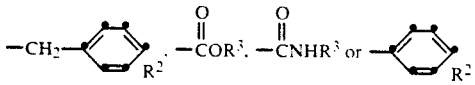

where $R^2$ is hydroxy or a hydroxy-substituted alkyl group having from 1 to 4 carbon atoms and $R^3$ is an alkyl group having from 1 to 4 carbon atoms.

These hydrazides are described in Looker et al, U.S. Pat. No. 4,994,365, issued Feb. 19, 1991.

While certain preferred hydrazine compounds that are useful in this invention have been specifically described hereinabove, it is intended to include within the scope of this invention all hydrazine compound "nucleators" known to the art. Many such nucleators are described in "Development Nucleation By Hydrazine And Hydrazine Derivatives", Research Disclosure, Item 23510, Vol. 235, Nov. 10, 1983 and in numerous patents including U.S. Pat. Nos. 4,166,742, 4,168,977, 4,221,857, 4,224,401, 4,237,214, 4,241,164, 4,243,739, 4,269,929, 4,272,606, 4,272,614, 4,311,781, 4,332,878, 4,358,530, 4,377,634, 4,385,108, 4,429,036, 4,447,522, 4,540,655, 4,560,638, 4,569,904, 4,618,572, 4,619,886, 4,634,661, 4,650,746, 4,681,836, 4,686,167, 4,699,873, 4,722,884, 4,725,532, 4,737,442, 4,740,452, 4,912,016 and 4,914,003.

In the improved contact film of this invention, an interlayer is positioned between the silver halide emulsion layer and the overcoat layer. The interlayer is intended to serve primarily as a spacing layer. It has a thickness of at least twice, and more preferably at least three times, that of the overcoat layer.

Image manipulation, which has been briefly referred to hereinabove, is a critical consideration in regard to the structural arrangement of the layers in the novel photographic films described herein and particularly in regard to the thickness and properties of the interlayer. In many types of photographic films, it is highly advantageous for the spread function to be small because this enhances image sharpness and thereby enables the preparation of high quality enlargements. Most contact films used in the field of graphic arts are comprised of very small silver halide grains in order to provide low speeds and, as a consequence, the spread function tends to be small. However, in such graphic arts films, the impression of quality is derived from the acutance at edges, for both dots and lines, which is driven by sensitometric curve shape, and thus spread function is not important in regard to image quality. It is, however, very important in regard to image manipulation; the term "image manipulation" referring to the ability to optically change the size of halftone dots and lines by reducing or increasing the exposure given.

Image manipulation is extremely important in adjustment of color reproduction in the final print as well as for tonal changes. Small spread functions are the enemy of image manipulation. This is clear upon considering the mechanism of increasing the area of a halftone dot solely by use of exposure. The image space of a halftone dot or line edge is the convolution of the original image with the spread function of the imaging system. In a contact printing situation, it is almost entirely the spread function of the emulsion. Thus, graphic arts contact films pose a dilemna. The necessary use of fine grain emulsions provides small spread functions, whereas large spread functions are needed to effectively manipulate the images.

In the novel photographic films of this invention, the interlayer serves as an efficient means to degrade the emulsion spread function in a contact printing environment. The interlayer provides a physical space between the image and the radiation-sensitive emulsion and this space enhances lateral spreading of the exposing radiation and creates a softer image edge profile.

To achieve an effective degree of optical spread, it is necessary that the interlayer have a refractive index in the range of from about 1.4 to about 1.7, and more preferably in the range of from about 1.55 to about 1.65.

The interlayer is comprised of a mixture of a polymer latex and a hydrophilic colloid. The purpose of the polymer latex is to impart the necessary dimensional stability to the film and for this purpose, it is employed in an amount of from about 0.2 to about 1.5 parts per part by weight of the hydrophilic colloid. The hydrophilic colloid incorporated in the interlayer can be selected from among those described above as being useful in the emulsion layer and can be the same or different than the particular hydrophilic colloid used in the emulsion layer. Most preferably, the hydrophilic colloid in the interlayer is gelatin. The polymer latex incorporated in the interlayer can be selected from among those described above as being useful in the emulsion layer and can be the same or different than the polymer latex used in the emulsion layer. Most preferably, the polymer latex in the interlayer is poly(methylacrylate-co-2-acrylamido-2-methylpropane sulfonic acid).

The thickness of the interlayer is typically in the range of from about 0.5 to about 5 microns, preferably in the range of from about 0.8 to about 3.5 microns, and most preferably in the range of from about 1.7 to about 3 microns.

The overcoat layer in the improved contact film of this invention is comprised of a hydrophilic colloid, a matting agent and a light-scattering agent. The hydrophilic colloid can be selected from among those described above as being useful in the emulsion layer and the interlayer and can be the same or different than the hydrophilic colloid used in those layers. Most preferably, the hydrophilic colloid in the overcoat layer is gelatin.

The overcoat layer comprises discrete solid particles of a matting agent typically having an average particle size in the range of from about 1 to about 5 microns and preferably in the range of from about 2 to about 4 microns. The matting agent is typically employed in an amount of from about 0.02 to about 1 part per part by weight of the hydrophilic colloid. Either organic or inorganic matting agents can be used. Examples of organic matting agents are particles, often in the form of beads, of polymers such as polymeric esters of acrylic and methacrylic acid, e.g., poly(methylmethacrylate), cellulose esters such as cellulose acetate propionate, cellulose ethers, ethyl cellulose, polyvinyl resins such as poly(vinyl acetate), styrene polymers and copolymers, and the like. Examples of inorganic matting agents are particles of glass, silicon dioxide, titanium dioxide, magnesium oxide, aluminum oxide, barium sulfate, calcium carbonate, and the like. Matting agents and the way they are used are further described in U.S. Pat. Nos. 3,411,907 and 3,754,924.

The overcoat layer also comprises discrete solid particles of a light-scattering agent typically having an average particle size in the range of from about 0.1 to about 5 microns, and preferably in the range of from about 0.5 to about 1.5 microns. The light-scattering agent is typically employed in an amount of from about 0.02 to about 1 part per part by weight of the hydrophilic colloid.

Either organic light-scattering agents, such as particles of polymethylmethacrylate, or inorganic light-scattering agents, such as silver halides, calcium carbonate, or silicon dioxide, can be used. The light-scattering agent used in this invention has particles large enough to scatter visible light and therefore to cause the formation of haze in the film. This is advantageous in enabling the user of the film to readily distinguish between the front and back surfaces. The amount of scattering is affected by the size and shape of the particles and by the difference between the refractive index of the particles and the medium.

The light-scattering agent in the overcoat layer enhances the degree of optical spread achieved during contact exposure and thereby enables the combined thickness of the emulsion layer, interlayer and overcoat layer to be kept below that at which dimensional stability would be seriously harmed or processing times would be unduly prolonged.

If desired, the same particles can be used in the overcoat layer to serve as both the matting agent and the light-scattering agent. For example, polymethylmethacrylate beads or silicon dioxide particles of suitable size can serve reasonably well in both capacities. It is preferred, however, to use different materials as the matting agent and the light-scattering agent, so that each can have optimum properties for its particular purpose. In particular, it is preferred to use polymethyl methacrylate beads with an average particle size of about 4 microns as the matting agent and silica particles with an average size of about 2 microns as the light-scattering agent.

Particles used as matting agents and light-scattering agents in the present invention can be of essentially any shape. Their size is typically defined in terms of mean diameter. Mean diameter of a particle is defined as the diameter of a spherical particle of identical mass. Polymer particles that are in the form of spherical beads are preferred for use as matting agents.

The thickness of the overcoat layer is typically in the range of from about 0.2 to about 1 microns, preferably in the range of from about 0.3 to about 0.6 microns and most preferably in the range of from about 0.35 to about 0.45 microns.

The side of the support opposite to the emulsion layer, typically is coated with an anti-halation layer whose function is to prevent light that passes through the film support from being reflected into the image-forming layer and thereby causing an undesired spreading of the image which is known as halation. The anti-halation layer may in turn be overcoated with another layer which serves as a protective outermost layer.

The photographic film of this invention can be processed in developing solutions of the type which contain an amino compound which functions as a contrast-promoting agent or, as it is sometimes referred to, a "booster". These are described in Nothnagle, U.S. Pat. No. 4,269,929, issued May 26, 1981. An example of this type of developing solution is KODAK ULTRATEC DEVELOPER. It can also be processed in conventional developing solutions which do not contain an amino compound which functions as a contrast-promoting agent. An example of this type of developing solution is KODAK UNIVERSAL RAPID ACCESS DEVELOPER.

The photographic film of this invention can optionally contain an "incorporated booster". Amino compounds which are useful as incorporated boosters, i.e., boosters which are incorporated in the photographic element rather than in the developing solution, are described in Machonkin et al, U.S. Pat. No. 4,975,354, issued Dec. 4, 1990.

The amino compounds useful as "incorporated boosters" described in the aforesaid U.S. Pat. No. 4,975,354 are amino compounds which:

(1) comprise at least one secondary or tertiary amino group;

(2) contain within their structure a group comprised of at least three repeating ethyleneoxy units, and (3) have a partition coefficient, of at least one, preferably at least three, and most preferably at least four.

Included within the scope of the amino compounds that can be utilized in this invention as "incorporated boosters" are monoamines, diamines and polyamines. The amines can be aliphatic amines or they can include aromatic or heterocyclic moieties. Aliphatic, aromatic and heterocyclic groups present in the amines can be substituted or unsubstituted groups. Preferably, the amino compounds employed in this invention as "incorporated boosters" are compounds of at least 20 carbon atoms.

Preferred amino compounds for use as "incorporated boosters" are bis-tertiary-amines which have a partition coefficient of at least three and a structure represented by the formula:

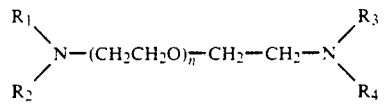

wherein n is an integer with a value of 3 to 50, and more preferably 10 to 50, $R_1$, $R_2$, $R_3$ and $R_4$ are, independently, alkyl groups of 1 to 8 carbon atoms, $R_1$ and $R_2$ taken together represent the atoms necessary to complete a heterocyclic ring, and $R_3$ and $R_4$ taken together represent the atoms necessary to complete a heterocyclic ring.

Another advantageous group of amino compounds for use as "incorporated boosters" are bis-secondary amines which have a partition coefficient of at least three and a structure represented by the formula:

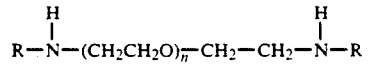

wherein n is an integer with a value of 3 to 50, and more preferably 10 to 50, and each R is, independently, a linear or branched, substituted or unsubstituted, alkyl group of at least 4 carbon atoms.

Preferably the group comprised of at least three repeating ethyleneoxy units is directly linked to a tertiary amino nitrogen atom and most preferably the group comprised of at least three repeating ethyleneoxy units is a linking group joining tertiary amino nitrogen atoms of a bis-tertiary-amino compound.

The amino compound utilized as an "incorporated booster" is typically employed in an amount of from about 1 to about 25 millimoles per mole of silver, and more preferably in an amount of from about 5 to about 15 millimoles per mole of silver.

Other amino compounds useful as "incorporated boosters" are described in Yagihara et al, U.S. Pat. No. 4,914,003 issued Apr. 3, 1990. The amino compounds described in this patent are represented by the formula:

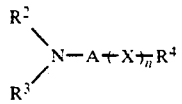

wherein $R^2$ and $R^3$ each represent a substituted or unsubstituted alkyl group or may be linked to each other to form a ring; $R^4$ represents a substituted or unsubstituted alkyl, aryl or heterocyclic group; A represents a divalent linkage; X represents $—CONR^5—$, $—O—CONR^5$, $—NR^5CONR^5—$, $—NR^5COO—$, $—COO—$, $—OCO—$, $—CO—$, $—NR^5CO—$, $—SO_2NR^5—$, $—NR^5SO_2—$, $—SO_2—$, —S— or —O— group in which $R^5$ represents a hydrogen atom or a lower alkyl group and n represents 0 or 1, with the proviso that the total number of carbon atoms contained in $R^2$, $R^3$, $R^4$ and A is 20 or more.

As lithographic-type photographic elements, the films of this invention are preferably utilized (exposed and processed) as sheet films. As such, the films preferably have low curl (i.e., less than about 40 ANSI curl units at 21° C. and 15% relative humidity, using ANSI PH 1.29-1971, which calls for matching the curl of sample strips on a template of curves of varying radii to determine the radius of curvature and reporting the value of 100/R as the degree of curl where R is the radius of curvature in inches) and high dimensional stability (humidity coefficient, defined as % change in linear dimension divided by change in percent humidity over a 15-50% relative humidity range at 21° C., of less than about 0.0015).

The invention is further illustrated by the following examples of its practice.

Element A, which is employed herein as a control, is comprised of a poly(ethylene terephthalate) film support, a silver halide emulsion layer overlying the film support, and a protective overcoat layer overlying the silver halide emulsion layer. On its opposite side, the film support is coated with an antihalation layer and a backing layer which overlies the antihalation layer. The silver halide emulsion layer is comprised of a negative-working silver chloride emulsion, doctored with 4-hydroxy-6-methyl-1,3,3a, 7-tetraazaindene, containing silver halide grains capable of forming a surface latent image and has a dry thickness of 5 microns. The silver halide grains are described in Example 1 of U.S. Pat. No. 4,933,272, to which reference has been made hereinabove, and incorporate, as a dopant, the compound $K_2Ru(NO)Br_5$ in an amount of 6 milligrams per mole of silver. The emulsion layer contains gelatin as a binder and a polymer latex, poly(methylacrylate-co-2-acrylamido-2-methyl propane sulfonic acid), is incorporated therein in an amount of 0.75 parts per part by weight of gelatin to improve dimensional stability. The overcoat layer is comprised of gelatin, polymethylmethacrylate beads with an average size of 4 microns in an amount of 0.02 parts per part by weight of gelatin, and silica with an average particle size of 2 microns in an amount of 0.025 parts per part by weight of gelatin, and has a dry thickness of 0.4 microns.

Elements B, C, and D are identical to Element A, except that each of them includes an interlayer interposed between the silver halide emulsion layer and the overcoat layer. In each case, the interlayer has a refractive index of 1.6 and a dry thickness as indicated in Table I below, and is composed of gelatin and one part, per part by weight of gelatin, of poly(methylacrylate-co-2-acrylamido-2-methyl propane sulfonic acid).

Elements A', B', C' and D' correspond, respectively, to elements A, B, C and D, except that each of them includes in the silver halide emulsion layer 32 milligrams per square meter of the nucleating agent 1-formyl-2-(4-[2-(2,4-di-tert-pentylphenoxy)butyramido]-phenyl)hydrazine.

A sample of each of elements A, B, C, D, A', B', C' and D' was exposed on a graphic arts contact printer unit, developed for 38 seconds at 35° C. in Developer A, as hereinafter described, and fixed for 33 seconds at 35° C.

Developer A is of the type which does not contain an amino compound that functions as a booster. To prepare Developer A, a concentrate was formulated from the following ingredients:

| | |
|---|---|
| Sodium metabisulfite | 145 g |
| 45% Potassium hydroxide | 178 g |
| Diethylenetriamine pentaacetic acid pentasodium salt (40% solution) | 15 g |
| Sodium bromide | 12 g |
| Hydroquinone | 65 g |
| 1-Phenyl-4-hydroxymethyl-4-methyl-3-pyrazolidone | 2.9 g |
| Benzotriazole | 0.4 g |
| 1-Phenyl-5-mercaptotetrazole | 0.05 g |
| 50% Sodium hydroxide | 46 g |
| Boric acid | 6.9 g |
| Diethylene glycol | 120 g |
| 47% Potassium Carbonate | 120 g |
| Water to one liter | |

The concentrate was diluted at a ratio of one part of concentrate to four parts of water to produce a working strength developing solution with a pH of 10.4.

A sample of each of elements A, B, C, D, A', B', C' and D' was exposed on a graphic arts contact printer unit, developed for 38 seconds at 35° C. in Developer B, as hereinafter described, and fixed for 33 seconds at 35° C.

Developer B is of the type described in U.S. Pat. No. 4,269,929, which contains an amino compound that functions as a booster. Developer B has a pH of 11.6 and is composed of the following ingredients:

| | |
|---|---|
| Pentasodium salt of nitrilotrimethylene-phosphonic acid (40% solution) | 6.6 cc |
| Diethylenetriamine pentaacetic acid pentasodium salt (40% solution) | 3.2 g |
| Sodium bromide | 3 g |
| Phosphoric acid (75% solution) | 47.4 g |
| Potassium hydroxide (45% solution) | 132 g |
| Sodium metabisulfite | 52.5 g |
| Sodium hydroxide (50% solution) | 68 g |
| 1-Phenyl-5-mercaptotetrazole | 12 mg |
| 5-Methylbenzotriazole | 0.25 g |
| Hydroquinone | 35 g |
| 1-Phenyl-4-hydroxymethyl-4-methyl-3-pyrazolidone | 0.3 g |
| 3-Diethylamino-1,2-propanediol | 19.7 g |
| Water to one liter | |

Each sample was evaluated to determine Multilayer Image Quality (MLIQ), and the results obtained are summarized in Table I below.

TABLE I

| Element | Interlayer Thickness (microns) | Amount of Nucleator ($mg/m^2$) | MLIQ (% Dot Area) Developer A | Developer B |
|---|---|---|---|---|
| A | 0 | 0 | 74.2 | 69.4 |
| B | 1.032 | 0 | 68.5 | 67.5 |
| C | 2.064 | 0 | 67.1 | 65.4 |
| D | 3.096 | 0 | 66.7 | 64.5 |
| A' | 0 | 32 | 74.4 | 60.5 |
| B' | 1.032 | 32 | 67.0 | 61.8 |
| C' | 2.064 | 32 | 66.6 | 65.4 |
| D' | 3.096 | 32 | 66.8 | 64.4 |

In the evaluation of MLIQ, Kanji characters, i.e. characters belonging to the Kanji system of writing that is used in Japan, are simultaneously exposed with scanner halftone dots in the E-E configuration. The measure of MLIQ reported above is the percent dot area of a 150 line per inch halftone positioned in the same layer as the Kanji characters. The value of this dot pattern, measured at the exposure where the E-E scanner halftone is acceptable, is a measure of the quality of the Kanji characters. The quality increases as the percent dot area decreases.

In considering the data reported in Table I, it should be noted that elements B, C and D are representative of the invention of the aforesaid U.S. patent application Ser. No. 590,707, filed Sep. 24, 1990, elements B', C' and D' are representative of the present invention which employs both an interlayer and a nucleating agent, and elements A and A' are outside the scope of both of these inventions.

As indicated by the data in Table I, the novel photographic elements of this invention exhibit chemical spread attributable to the presence of the nucleating agent and optical spread attributable to the presence of the interlayer. They perform well in both conventional rapid access developers—such as KODAK UNIVERSAL RAPID ACCESS DEVELOPER—which do not contain an amino compound that functions as a booster, and in developers, such as KODAK ULTRATEC DEVELOPER, which contain an amino compound that functions as a booster. By combining both chemical spread and optical spread, they provide an improved film from the standpoint of exposure latitude and repeatability.

Note that the chemical spread provided by the nucleating agent is decreased as interlayer thickness increases—probably as a result of diffusion of the nucleating agent—so that a balance between the degree of chemical spread and the degree of optical spread is selected for optimum performance of a given film. The optimum thickness for the interlayer is dependent, in part, on the amount of nucleating agent incorporated in the film and the extent to which it tends to diffuse.

A film such as element A', which contains a nucleator but has no interlayer, gives good MLIQ values in Developer B, but poor values in Developer A. A film such as element A, which contains neither nucleator nor interlayer, gives poor MLIQ values in both Developer A and Developer B. Films within the scope of the present invention, such as elements B', C' and D', give good MLIQ values in both types of developer. This provides added convenience for the customer, who may also be processing a variety of other types of films, and benefits from freedom to intermix films as desired. The photographic film of this invention, which is characterized by both the presence of an interlayer and a hydrazine nucleator, has the further advantage that it exhibits a combination of highly desirable physical and sensitometric properties.

The invention has been described in detail with particular reference to preferred embodiments thereof, but it will be understood that variations and modifications can be effected within the spirit and scope of the invention.

We claim:

1. A high-contrast room-light-handleable black-and-white silver halide photographic film which is especially adapted for use as a dry-dot-etchable contact film in the graphic arts by its ability to provide both optical spread and chemical spread; said film comprising a support having in order on one side thereof:

(1) a radiation-sensitive layer comprising silver halide grains, a hydrophilic colloid and a polymer latex, (2) an interlayer consisting essentially of a hydrophilic colloid and a polymer latex, and (3) an overcoat layer consisting essentially of a hydrophilic colloid, a matting agent having an average particle size in the range of from about 1 to about 5 microns and a light-scattering agent having an average particle size in the range of from about 0.1 to about 5 microns; said interlayer having a refractive index in the range of from aobut 1.4 to about 1.7 and a thickness which is at least twice that of said overcoat layer and is in the range of from about 0.5 to about 5 microns; said film additionally comprising an effective amount of a hydrazine compound which functions as a nucleating agent and is present in said radiation-sensitive layer or a layer contiguous thereto.

2. A photographic film as claimed in claim 1 wherein said hydrophilic colloid in each of said radiation-sensitive layer, interlayer and overcoat layer is gelatin.

3. A photographic film as claimed in claim 1 wherein said interlayer has a thickness in the range of from about 0.8 to about 3.5 microns.

4. A photographic film as claimed in claim 1 wherein said interlayer has a thickness in the range of from about 1.7 to about 3 microns.

5. A photographic film as claimed in claim 1 wherein said overcoat layer has a thickness in the range of from about 0.2 to about 1 microns.

6. A photographic film as claimed in claim 1 wherein said polymer latex in said radiation-sensitive layer is present in an amount of from about 0.2 to about 1.5 parts per part by weight of said hydrophilic colloid in said radiation-sensitive layer.

7. A photographic film as claimed in claim 1 wherein said polymer latex in said interlayer is present in an amount of from about 0.2 to about 1.5 parts per part by weight of said hydrophilic colloid in said interlayer.

8. A photographic film as claimed in claim 1 wherein said silver halide grains are doped with a doping agent, containing a nitrosyl or thionitrosyl coordination ligand and a transition metal of groups 5 to 10 of the periodic table of elements, in an amount sufficient to provide a level of photosensitivity which permits room-light-handling of said film.

9. A photographic film as claimed in claim 1 wherein said silver halide grains are doped with a doping agent in an amount sufficient to provide a level of photosensitivity which permits room-light-handling of said film, said doping agent being a transition metal coordination complex of the formula:

$[M(NX)(L)_5]_n$ wherein M is a ruthenium, rhenium, chromium, osmium or iridium transition metal, X is oxygen or sulfur, L is a ligand, and n is −1, −2, or −3.

10. A photographic film as claimed in claim 1 wherein said matting agent is present in said overcoat layer in an amount of from about 0.02 to about 1 part per part by weight of said hydrophilic colloid in said overcoat layer.

11. A photographic film as claimed in claim 1 wherein said light-scattering agent is present in said overcoat layer in an amount of from about 0.02 to about 1 part per part by weight of said hydrophilic colloid in said overcoat layer.

12. A photographic film as claimed in claim 1 wherein the same material serves in said overcoat layer as both said matting agent and said light-scattering agent.

13. A photographic film as claimed in claim 1 wherein said matting agent is comprised of polymethyl methacrylate beads and said light-scattering agent is comprised of particles of silica.

14. A photographic film as claimed in claim 1 wherein said radiation-sensitive layer contains from about $10^{-4}$ to about $10^{-1}$ moles of said hydrazine compound per mole of silver.

15. A photographic film as claimed in claim 1 wherein said hydrazine compound is 1-formyl-2-(4-[2-(2,4-di-tert-pentylphenoxy)butyramido]phenyl) hydrazine.

16. A high-contrast room-light-handleable black-and-white silver halide photographic film which is especially adapted for use as a dry-dot-etchable contact film in the graphic arts by its ability to provide both optical spread and chemical spread; said film comprising a support having in order on one side thereof:

(1) a radiation-sensitive layer comprising gelatin, a hydrazine compound which functions as a nucleating agent, a polymer latex and silver halide grains doped with a doping agent in an amount sufficient to provide a level of photosensitivity which permits room-light-handling of said film, said doping agent being a transition metal coordination complex of the formula:

$[M(NX)(L)_5]_n$ wherein M is a ruthenium, rhenium, chromium, osmium or iridium transition metal, X is oxygen or sulfur, L is a ligand, and n is −1, −2, or −3;

and said radiation-sensitive layer having a thickness in the range of from aobut 2 to about 4 microns;

(2) an interlayer consisting essentially of gelatin, and a polymer latex and having a refractive index in the range of from about 1.55 to about 1.65 and a thickness of about 1 micron; and (3) an overcoat layer consisting essentially of gelatin, a matting agent having an average particle size in the range of from about 1 to about 5 microns and a light-scattering agent having an average particle size in the range of from about 0.1 to about 5 microns, said overcoat layer having a thickness of about 0.4 microns.

17. A photographic film as claimed in claim 16 wherein said hydrazine compound is 1-formyl-2-(4-[2-(2,4-di-tert-pentylphenoxy)butyramido]phenyl) hydrazine, said doping agent is $K_2Ru(NO)Br_5$, said polymer latex in both said radiation-sensitive layer and said interlayer is poly(methylacrylate-co-2-acrylamido-2-methyl propane sulfonic acid), said matting agent consists of polymethyl methacrylate beads with an average size of 4 microns, and said light-scattering agent consists of particles of silica with an average size of 2 microns.

* * * * *